US006719249B2

(12) United States Patent
MacIntyre

(10) Patent No.: US 6,719,249 B2
(45) Date of Patent: Apr. 13, 2004

(54) TARGET SUPPORT

(76) Inventor: S. Scott MacIntyre, 937 Brownfield Rd., Eaton, NH (US) 03832

( * ) Notice: Subject to any disclaimer, the term of this patent is extended or adjusted under 35 U.S.C. 154(b) by 0 days.

(21) Appl. No.: 10/426,693

(22) Filed: May 1, 2003

(65) Prior Publication Data

US 2003/0205648 A1 Nov. 6, 2003

Related U.S. Application Data

(60) Provisional application No. 60/376,870, filed on May 2, 2002.

(51) Int. Cl.[7] ..... A45F 3/44

(52) U.S. Cl. ..... 248/156; 40/607.06; 40/612; 248/545

(58) Field of Search ..... 248/156, 530, 248/532, 228.5, 230.5, 231.61, 545; 40/607.02, 607.04, 607.06, 607.1, 607.11, 610, 612; 52/165

(56) References Cited

U.S. PATENT DOCUMENTS

| | | | | | |
|---|---|---|---|---|---|
| 394,854 | A | * | 12/1888 | Helfenberger et al. | 52/116 |
| 844,726 | A | * | 2/1907 | Hunter | 52/165 |
| 884,772 | A | * | 4/1908 | Sorensen | 248/229.12 |
| 2,022,160 | A | * | 11/1935 | Sorensen et al. | 40/612 |
| 2,559,302 | A | * | 7/1951 | Louft | 40/607.04 |
| 3,143,817 | A | * | 8/1964 | Paulson | 40/607.06 |
| 3,241,798 | A | * | 3/1966 | Nestor | 248/156 |
| 3,304,041 | A | * | 2/1967 | Priore | 248/156 |
| 3,441,239 | A | * | 4/1969 | Frost | 248/545 |
| 3,519,234 | A | * | 7/1970 | Matson | 248/156 |
| 4,412,396 | A | * | 11/1983 | Silbernagel | 40/607.11 |
| 4,644,713 | A | * | 2/1987 | Lehman | 52/165 |
| 4,726,132 | A | * | 2/1988 | Ernest | 40/607.1 |
| 4,846,140 | A | * | 7/1989 | DiMartino | 248/156 |
| 4,888,894 | A | * | 12/1989 | Brown, Jr. | 40/607.02 |
| 5,050,828 | A | * | 9/1991 | Wolff | 248/156 |
| 5,067,683 | A | * | 11/1991 | Wager | 248/545 |
| 5,181,335 | A | * | 1/1993 | Todd | 248/156 |
| 5,375,801 | A | * | 12/1994 | Porter | 248/156 |
| 5,446,984 | A | * | 9/1995 | Kulp et al. | 40/610 |
| 6,039,298 | A | * | 3/2000 | Stier | 248/545 |

OTHER PUBLICATIONS

Birchwood Casey Products, Portable Shooting Range, Jan. 2002.

MTM Caseguard Products, Jammit Compact Target Stand, Catalog No. JMCTS–40, Jammit Target Stand, Catalog No. JMTS–40, Jan. 2002.

* cited by examiner

*Primary Examiner*—Anita King
(74) *Attorney, Agent, or Firm*—Mattingly, Stanger & Malur, P.C.

(57) ABSTRACT

A device used to hold/support a target or multiple targets in the ground for the purpose of target shooting with firearms, air guns, and the like. This target supporting device allows any size or thickness material typically used for target shooting to be securely embedded into the ground, regardless of the slope of the ground to the line of fire. Additionally, any type of card, board, or sign can be supported in the ground to post information such as yard sales, keep off the grass notices, trail maintenance, etc.

2 Claims, 3 Drawing Sheets

TARGET SUPPORT

This application claims the benefit of provisional application Ser. No. 60/376,870 filed on May 2, 2002.

FIELD OF THE INVENTION

The present invention relates to the activity of target shooting in general, and in particular to a universal target support device that will securely support any material common to target shooting in the ground. The support device is compact in size, light in weight, survivable in the event of inadvertent bullet impact, and is economical to manufacture.

BACKGROUND OF THE INVENTION

Informal target shooting in the United States is a popular activity. There are a number of different portable target supports commercially available to meet this growing demand.

One of the most common commercially available supports is a square steel frame, open in the center, and fabricated (usually with welded joints) from round heat-treated steel. Typically, the outer legs of the support protrude below, but perpendicular to the lowest cross member of the main frame. These legs in turn are embedded into the ground in front of a backstop to support the frame in a vertical position, facing the shooter. A consumable target backing, typically made from cardboard, is then affixed to the frame with spring clips. The paper targets are then hung on this backing.

This type of target frame is often too large and heavy to be carried in a backpack or range bag for transportation purposes. Additionally, these frames are relatively expensive to manufacture, and can be rendered unserviceable in the field by inadvertently shooting one of the frame members with a bullet, resulting in a difficult repair procedure.

Another popular target support commercially available is a combination plastic and steel unit. This type of support employs one or two "stakes" made from steel that are riveted to a molded plastic upright. A similarly molded plastic target backing support member is fitted over and perpendicular to the upright using a molded male/female, boss/receiver arrangement. A row of molded plastic "fingers" capture and hold a consumable target backer, such as cardboard, against the rearmost supporting surface of the cross member onto which the targets themselves are hung.

This type of target support is much lighter than the all steel frame unit previously described, and the ability to be disassembled easily makes it somewhat more compact for transportation and storage. However, this particular support is still too bulky to fit easily inside a typical backpack or range bag. It is also limited somewhat by the inability of the molded plastic support fingers to accommodate any target backing other than standard corrugated cardboard or poster board in thickness.

SUMMARY OF THE INVENTION

As part of the present invention, it is recognized that the current commercially available target shooting frames and supports, while effective in supporting targets, are too bulky to fit inside a backpack or range bag for easy transportation to remote shooting locations. This is an activity enjoyed by a significant number of target shooters. The weight of some of these supports can also be a prohibitive factor with respect to carrying them in the field. Accordingly, it is one object of the present invention to provide a target support that is both compact in size and light in weight, while still providing the desired function of an effective target support.

It is also recognized that target supports of the prior art are often limited as to the type and thickness of the material that can be held. It is therefore another object of the present invention to provide a target support that will hold any thickness of target material and securely clamp it in place.

It is further recognized that a simple and effective method for posting signage in the ground would be a benefit to the general population as a whole. It is a further object of the present invention to provide a easy means to post signage anywhere.

BRIEF DESCRIPTION OF THE PREFERRED EMBODIMENT

Figure 8:
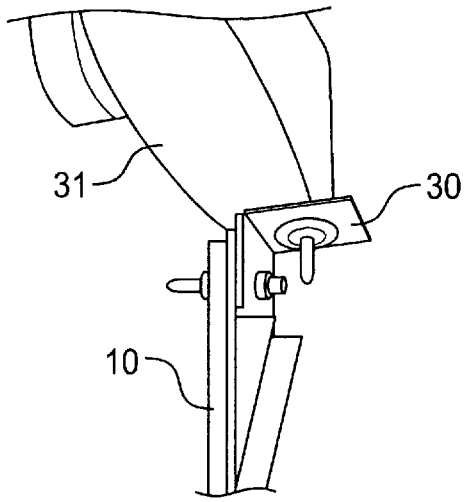

FIG. 8 is a picture of a multi-use accessory adapter used to mount any device that incorporates a standard threaded tripod adapter in its base. The adapter is shown mounted to the body of the present invention. The adapter mounts in place of the backing plate.

Figure 9:
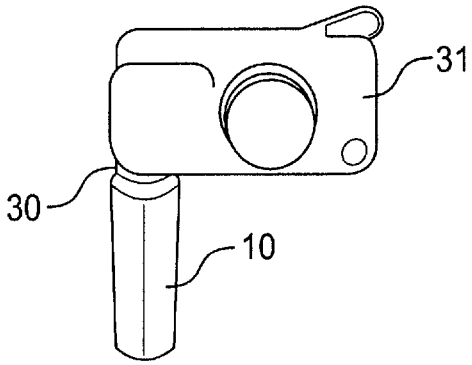

FIG. 9 is a picture of a pocket 35 mm camera mounted to the present invention using the multi-use accessory adapter pictured in FIG. 8.

Figure 10:
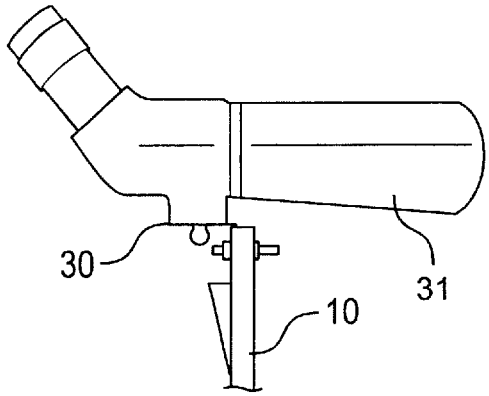

FIG. 10 is a picture of a typical spotting scope used for target shooting or scouting, mounted to the present invention using the multi-use accessory adapter pictured in FIG. 8.

DETAILED DESCRIPTION OF THE PREFERRED EMBODIMENT

A support body 10, normally but not exclusively manufactured from steel. It is noted as part of the present invention that the manufacture the body in various sizes and from different materials, such as aluminum or plastic, is possible without altering the basic functional configuration.

The body 10 is shaped similarly to a conventional tent stake, in that it has a long center axis 11 from which two surfaces 12 extend away in the direction of a common plane, forming an included angle approximating 90 degrees.

These angled surfaces form a taper 14 that extends along the center axis 11 of the body 10. One end of the body tapers down to form a point 15 that facilitates embedding the body of the support 10 into the ground.

The surfaces tapering up from the point 15 along the center axis 11, blend into a pair of rearward bends 16 formed on either side of the rearward extending surfaces 12. These secondary bends 16 form two parallel planes 17 where the two rearward facing target-clamping surfaces 18 are formed.

The rearward extending surfaces 18 are met by two upward facing surfaces or "shelves" 19 formed at right angles to the clamping surfaces 18, which serve to support a target or target backing in the plane parallel with the center axis 11 of the body 10.

A threaded fastener 20 is passed through a hole 21 located toward the top of the body of the support 10 where it is rotated into the mating thread 22 of the backing plate 23.

As the fastener is rotated, the helix of the mating threads draw the backing plate 23 toward the two rearward facing clamping surfaces 18 of the body 10. Once contact is made between the clamping surfaces of the body 18 and the backing plate 23, holding force is exerted at the contact points between these mating surfaces through the additional tightening of the threaded fastener 20.

Figure 1:
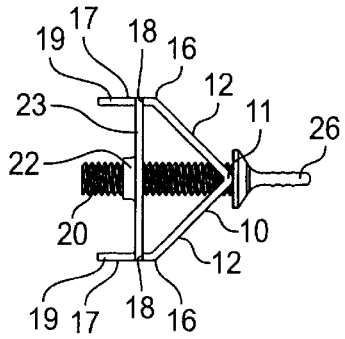
FIG. 1 is a plan view of the target support of the present invention.
Figure 2:
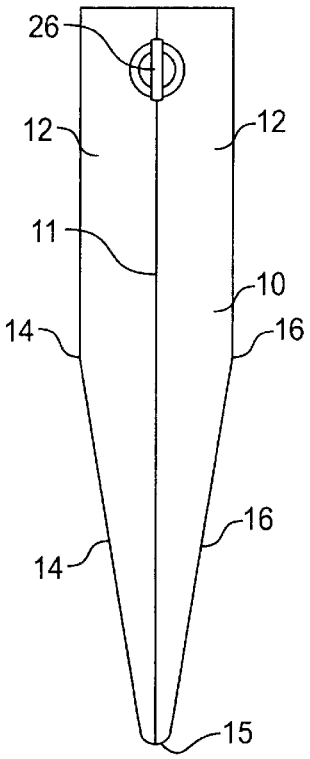
FIG. 2 is a front view of the target support of the present invention.
Figure 3:
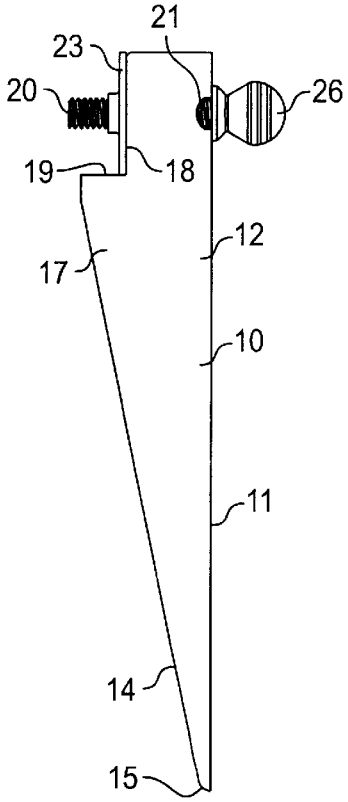
FIG. 3 is a side view of the target support of the present invention.
Figure 4:
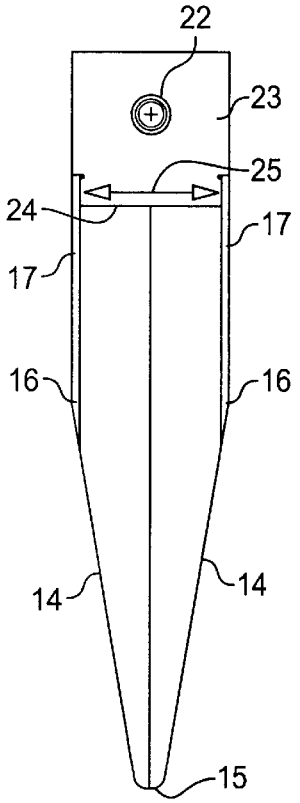
FIG. 4 is a back view of the target support of the present invention.
Figure 5:
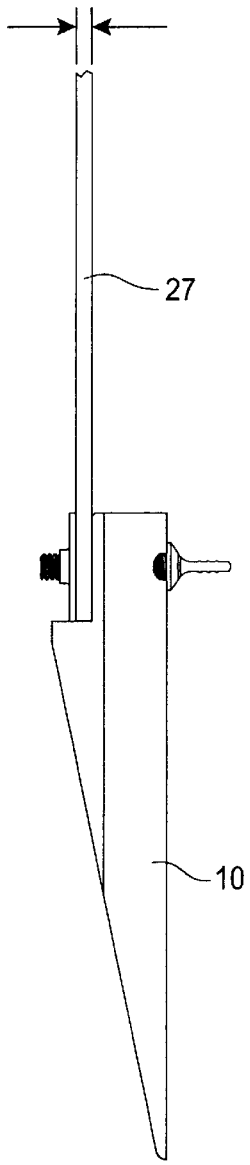
FIG. 5 is a side view of the target support of the present invention with a thin target backing approximating the thickness of cardboard clamped between the body of the support and the threaded backing plate.
Figure 6:
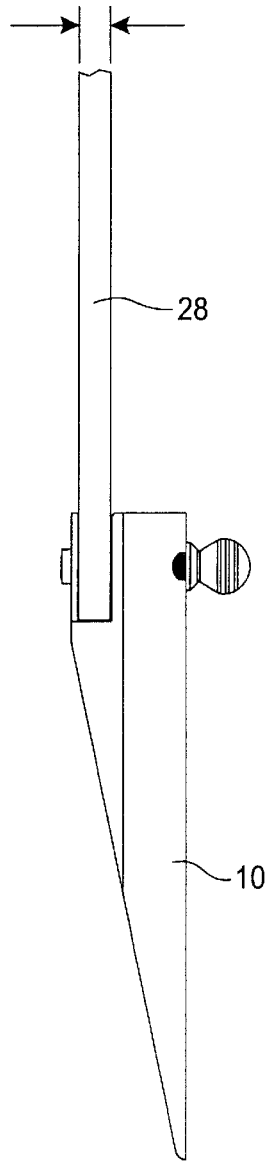
FIG. 6 is a side view of the target support of the present invention with a target backing approximating the thickness of a wooden 1×3 clamped between the body of the support and the threaded backing plate.
Figure 7:
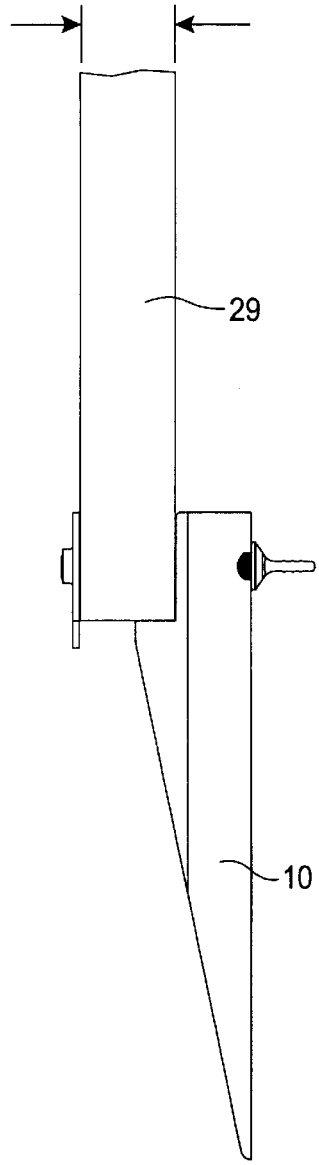
FIG. 7 is a side view of the target support of the present invention with a target backing approximating the thickness of a wooden 2×4 clamped between the body of the support and a threaded backing or clamping plate.

This clamping action is the essential method by which any thickness target or target backing can be securely fastened to the body of the support. As is readily apparent, it is preferable to form a notch or cut out in the target or target backing corresponding to the threaded fastener 20 to ensure that the target or target backing rests or is supported on the two upward facing surfaces or "shelves" 19 as shown in FIGS. 5–7.

The lower edge 24 of the backing plate 23 has an area of reduced width 25 (between arrowheads) that extends a short distance below the two target support shelves 19 in the body 10, and between the two rearward facing parallel surfaces 18. This stepped down area 25 of the backing plate 23 secures it axially to the body as the fastener 20 is rotated, allowing for single-handed operation of the clamping mechanism when securing a target. Additionally, the overall width of the backing plate 23 is slightly narrower and captured centrally to the body of the support 10 to prevent inadvertent bullet impact from striking the backing plate 23 and bending it rearward.

The body of the target support 10 has been designed to be survivable in the event of inadvertent bullet impact. The rearward angled tapered surfaces 12 of the body 10 extending back from the center axis 11 allow bullet impact to be absorbed angularly as a bullet grazes along either of these two surfaces 12.

Additionally, the head 26 of the threaded fastener 20 has a very slim profile as viewed from the front, increasing its survivability from bullet impact, while still providing enough surface area on the head to hand tighten the screw without the need for tools.

FIGS. 5–7 show a side view of the target support of the present invention 10 with three progressively thicker target backings (arrows), illustrating how the support assembly accommodates materials of varying thickness.

FIG. 5 depicts a thin backing 27 approximating the thickness of cardboard.

FIG. 6 depicts a target approximating the thickness of a standard 1×3 28 as might be used for a wooden target frame.

FIG. 7 depicts a target approximating the thickness of a standard 2×4 29 used as a stronger support than shown in FIG. 6 as a wooden target frame.

FIG. 8 shows a multi-use accessory adapter 30 mounted to the body of the present invention 10. It is mounted simply by replacing the backing plate 23 using the standard threaded fastener 20. A 35 mm camera 31 is shown mounted to the adapter 30 with the adapter mounted to the body of the support 10.

FIG. 9 shows another view of the same camera 31 shown in FIG. 8 mounted to the multi use accessory adapter 30, which in turn is mounted to the support of the present invention 10 shown embedded in the ground, as it would be during use in the field.

FIG. 10 shows a typical spotting scope 32 mounted to the same adapter 30, which in turn is mounted to the support 10, which is embedded in the ground as in FIG. 9.

CONCLUSION

The target support of the present invention is advantageous in that it is light in weight, compact in size, and versatile in its ability to accommodate a wide range of size, type, and material thickness of targets and target frames. The target support is also economical to manufacture and distribute. Further, the target support of the preferred embodiment is able to withstand the impact of a bullet and is also able to be easily repaired using basic hand tools in the event of severe bullet impact. The support is also capable being used to post other non-target related signage such as a "keep off the grass" notices and to accommodate an accessory adapter for use as a portable camera or spotting scope support for use in the field.

I claim:

1. A target support comprising:

a single stake having a tapered ground penetrating end and an opposite target supporting end;

said stake having a long central axis with two sides extending outwardly from said axis with an included angle of approximately 90° terminating in edges;

support shelves extending rearwardly from each of said sides at said target supporting end of said stake, respectively, and each having a horizontal support surface for supporting a bottom edge of a target;

said stake having a through hole at said target supporting end, a clamp including a threaded shaft passing through said hole and a matching threaded plate that travels toward said edges to clamp a target between said plate and edges upon rotation of said threaded shaft.

2. A target holder according to claim 1, wherein said threaded shaft has a head having a slim profile.

* * * * *